US006585795B2

(12) United States Patent
Friedman et al.

(10) Patent No.: US 6,585,795 B2
(45) Date of Patent: Jul. 1, 2003

(54) COMPACTION OF POWDER METAL

(75) Inventors: Ira L. Friedman, 10 Bingham Hill Cir., Rumson, NJ (US) 07760; Richard Phillips, St. Marys, PA (US)

(73) Assignee: Ira L. Friedman, RedBank, NJ (US)

( * ) Notice: Subject to any disclaimer, the term of this patent is extended or adjusted under 35 U.S.C. 154(b) by 0 days.

(21) Appl. No.: 09/923,050

(22) Filed: Aug. 6, 2001

(65) Prior Publication Data

US 2002/0033073 A1 Mar. 21, 2002

Related U.S. Application Data

(60) Provisional application No. 60/223,362, filed on Aug. 7, 2000.

(51) Int. Cl.[7] ..... B22F 3/12
(52) U.S. Cl. ..... 75/228; 75/246; 419/38
(58) Field of Search ..... 919/38; 75/246, 75/228

(56) References Cited

U.S. PATENT DOCUMENTS 3,888,657 A * 6/1975 Klar et al. ..... 419/31
3,945,863 A * 3/1976 Precht ..... 419/23
4,968,481 A * 11/1990 Rerat ..... 419/23
5,460,641 A * 10/1995 Aslund et al. ..... 75/252
5,954,856 A * 9/1999 Pathare et al. ..... 75/255
6,334,882 B1 * 1/2002 Aslund ..... 75/228
6,348,081 B1 * 2/2002 Horata et al. ..... 75/246
6,355,207 B1 * 3/2002 Keyes ..... 419/10

* cited by examiner

*Primary Examiner*—Ngoclan Mai
(74) *Attorney, Agent, or Firm*—Francis Hand; Carella, Byrne, Bain et al.

(57) ABSTRACT

The method of compacting agglomerated powder comprises the steps of receiving a mass of agglomerated powder of random sizes; separating the mass into at least three distinct range of sizes including a fine range, a medium range and a coarse range; and thereafter compacting the agglomerated powder of each of the ranges into green briquettes, each of which is characterized in having a self-supporting structure to permit handling for a subsequent sintering operation to form a bonded compacted mass.

16 Claims, No Drawings

COMPACTION OF POWDER METAL

This application claims the benefit of Provisional Patent Application Ser. No. 60/223,362, filed Aug. 7, 2000.

As is known, various techniques have been developed for powder metal to obtain products which cannot be economically fabricated from metal by employing other techniques, such as, casting, forging, stamping and the like. In a general sense, a mass of powder metal may be compacted into a three dimensional shape and thereafter sintered in order to obtain a bonding together of the various particles of the powder mass to form the final product.

U.S. Pat. No. 5,460,641 describes a metallic powder comprised of an assembly of granules, each of which is comprised of a group of spherically shaped elementary metal particles agglomerated by gelatin. Such agglomerated particles have been employed for making various products and, in particular, in making stainless steel products.

There are two prevalent methods of compacting agglomerated powder metal parts. The first is uniaxial pressing (movement of a pressing tool in a single direction), for example, as described in U.S. Pat. No. 5,460,641, in which a controlled amount of powder is automatically gravity fed into a precision die and compacted, usually at room temperature, at a pressure as low as 10 tons per sq. in or as high as 60 or more tons per sq. in (138 to 827 MPa) depending on the density requirements of the part (Metal Powder Industries Federation "Design Solutions" brochure).

It has been found that agglomerated powders as described in U.S. Pat. No. 5,460,641 cause binding of the punch and die, squealing and scoring of the tools, increased ejection pressure, tool breakage and production of parts which are outside acceptable deviation limits on weight and size.

Another commonly used pressing method, particularly for Scanpac powders, is cold isostatic pressing (CIP). Cold or room temperature compaction is carried out in liquid systems at pressures commonly reaching 60,000 psi (414 MPa). The metal powder can be packed into complex-shaped rubber or elastomeric molds before compacting. Free of die frictional forces, the powder compact reaches a more uniform density.

Powders with spherical or rounded particles are not cold compacted because of their inability to form a sound or strong green body.

Sintering can be performed by any of the conventional processes (Metal Powder Industries Federation "Design Solutions: brochure). The agglomerated Scanpac powders have sufficient green strength to form a cohesive component for sintering. Since no metal punches or dies are used in cold isostatic pressing, scoring or breakage of the tooling is not an issue but uniformity of product is an issue.

Accordingly, it is an object of the invention to provide an economical method for compacting agglomerate powder materials.

It is another object of the invention to provide a method for producing commercially useful powders for volume production.

It is another object of the invention to provide an agglomerated powder that can be compacted in a uniaxial manner without damaging the elements used to compact the powder.

Briefly, the invention provides a method of compacting agglomerated powdered metal comprised of the steps of receiving a mass of agglomerated powder of random sizes; separating the mass into at least three distinct range of sizes including a fine range, a medium range and a coarse range; and thereafter compacting the agglomerated powder of one of the ranges into a green briquette characterized in having a self-supporting structure to permit handling for a subsequent sintering operation to form a bonded compacted mass. The agglomerated powder of each of the other ranges may be separately compacted into a green briquette characterized in having a self-supporting structure to permit handling for a subsequent sintering operation to form a bonded compacted mass.

One advantage of the invention is that the shape and size for the bonded compacted mass can be predetermined and the agglomerated powder can be compacted to this shape and size without distortion of the bonded compacted mass, i.e. without a linear deviation from the predetermined size and shape.

Another advantage of the invention is that the stresses placed on the tools used for compacting can be uniform so that the tools do not skew during compaction.

Binder die wall lubrication is generally adequate when tools are above 150° F. Above 150° F., the binder material system gives higher green strengths at room temperature and adequate die wall lubrication. It is recommended that 0.5% of EBS (Ethylene Biostearamide—Acrawax "C") be added to the powder to alleviate the lower temperature compaction lubrication inadequacy. This material delubes cleanly and is compactible with the binder. Addition of Acrawax "C" should be blended for a short blend time of 2 to 3 minutes in a non aggressive blender. Die wall lubrication has been found adequate and desirable with or without the Acrawax additions. The die wall lubricant should be a blend of 75% Acrawax "C" and Lauric Acid below 200 mesh.

Delubication is most critical before sintering. A gradual heating rate of briquettes to 888° F. (475° C.) is essential to remove the lubricant. The rate of heating in air should not exceed 20° F./min. to reduce internal pressure build up or surface eruptions. Parts should be delubed on a carrier that will be used in sintering. Preference for the carrier would be a smooth ceramic plate compatible with the base material of the briquette and 2600° F. temperature in 100% hydrogen.

Alternatively, the carrier should be made of a soft porous plate or surface that allows the lubricant and/or binder in the briquette to diffuse from the base of the briquette and that allows the briquette to slide on the carrier as the briquette shrinks during sintering. The porous plate or surface also allows the hydrocarbons in the briquette to escape rather than becoming entrapped and causing problems in the final product.

Sintering requires heating to 2540° F. in 100% H2 or Ar partial pressure. Time at temperature should be 60 minutes.

Net Result is 99.73% of Theoretical Density.

In accordance with this invention, the segmentation and use of segregated mesh size particles and the addition of a selected lubricant eliminate the problems encountered with the previously known methods of compacting agglomerated powders and creates commercially useful powders for volume production.

These and other objects and advantages of the invention will become more apparent from the following detailed description setting forth examples of using the method of the invention.

SCANPAC 316L Molding Analysis.

P/M Hex Nut Green Weight and Dimensional Analysis

A SCANPAC 316L agglomerated powder was molded to determine attributes of processing. Over 1000 pieces were molded to appraise production control characteristics.

The powder was pressed into a one-inch hex nut configuration using a conventional 60 ton Gasbarre press with tool steel die, punches, and core rod tooling. The press was operated in a fully automatic production mode. The powder was molded as received and size-cut conditions were Fisher mesh sizes +40, −40+60, and −60 (which for purposes of the method are defined as "coarse", "medium" and "fine" ranges) in the modified conditions. Quantities of 250 pieces of each condition were molded at 6.3 g/cc density. A sample was taken of every tenth part molded. These parts were measured for weight and thickness.

TABLE 1

Dimensional Analysis from Weight Measurements.

| Size | Standard | 40 | −40 + 60 | −60 |
|---|---|---|---|---|
| Average (g) | 13.0501 | 10.6153 | 8.7886 | 13.3488 |
| Deviation (g) | 0.3048 | 0.0980 | 0.0556 | 0.0918 |
| Range (g) | 1.1507 | 0.3592 | 0.2115 | 0.3380 |
| % Deviation | 2.336 | 0.900 | 0.633 | 0.688 |
| % Range | 8.818 | 3.380 | 2.407 | 2.532 |
| Linear Deviation (in/in) | 0.0076 | 0.003 | 0.0021 | 0.0023 |
| Linear Range (in/in) | 0.0285 | 0.0112 | 0.0080 | 0.0084 |

Based on the analysis of Table 1 for weight variation (which affects density variation), the size variation will not exceed +/−0.003 in/in when the part approaches full density. This is concluded by observation of the linear deviation of Lots A, B, C.

P/M Hex Nut Green Density and Dimensional Analysis

TABLE 2

Dimensional Analysis from Density Measurements.

| Size | Standard | +40 | −40 + 60 | −60 |
|---|---|---|---|---|
| Average (g/cc) | 6.24 | 6.35 | 6.27 | 6.62 |
| Deviation (g/cc) | 0.11 | 0.02 | 0.02 | 0.03 |
| Range (g/cc) | 0.52 | 0.09 | 0.07 | 0.10 |
| % Deviation | 1.763 | 0.315 | 0.319 | 0.453 |
| % Range | 8.333 | 1.417 | 1.116 | 1.511 |
| Linear Deviation (in/in) | 0.0058 | 0.0010 | 0.0011 | 0.0015 |
| Linear Range (in/in) | 0.0268 | 0.0047 | 0.0037 | 0.0050 |

Based on the analysis of molded density, which includes weight, thickness and volume for each part, the linear deviation and range was computed for parts at full density. It can be concluded that the powder as-received, molded, and sintered to full density will have a standard linear variation of +/−0.0058 inch and a range of 0.0268 inch or +/−0.0134 about the average. The sample lots had only +/−0.0010 inch to +/−0.0015 inch linear deviation and a range between 0.0037 to 0.0050 inch. These values are typical of P/M process showing good process control and capability.

The as-supplied Scanpac 316L agglomerated material when uniaxially molded does not have reasonable size and weight control. Using modified portions of the agglomerated size distribution reduces the variation and allows in process controls typical of the P/M process for each size-cut portion.

The invention thus provides a method of compacting agglomerated powder so that the resultant products have a uniform density throughout. Further, the method of the invention allows the dimensional control of the agglomerated powder being compacted to be readily obtained.

Employing a more uniform range of sizes in the agglomerated powder being compacted avoids distortion in the tools and dies used to compact the powder into a product and avoids producing uneven stresses or stress gradients in the tools and dies as well as in the bonded compacted powder.

Further, the invention provides a method of compacting a mass of agglomerated powder of random sizes into separate fractions, each of which results in a product having the same mass, volume and dimensions as each other. That is to say, whether one starts with a coarse range or a fine range, the final product which is compacted to a desired size and shape will have the same mass, volume and dimensions regardless of the particle size used.

What is claimed is:

1. A method of compacting agglomerated powder comprising the steps of receiving a mass of agglomerated powder of random sizes;

separating said mass into at feast three distinct range of sizes including a fine range, a medium range and a coarse range; and thereafter compacting the agglomerated powder of one of said ranges into a green briquette characterized in having a self-supporting structure to permit handling for a subsequent sintering operation to form a compacted mass.

2. A method as set forth in claim 1 wherein the agglomerated powder of each said range is separately compacted into a green briquette characterized in having a self-supporting structure to permit handling for a subsequent sintering operation to form a bonded compacted mass.

3. A method as set forth in claim 1 wherein said briquette is characterized in having a uniform density.

4. A method as set forth in claim 1 wherein said range of sizes include a Fisher mesh size of +40, −40 to +60 and −60.

5. A method as set forth in claim 1 wherein said mass of agglomerated powder is SCANPAC 316L.

6. A method as set forth in claim 1 which further comprises the steps of predetermining the shape and size for the bonded compacted mass and compacting the agglomerated powder to said shape and size without distortion of the compacted mass.

7. A method as set forth in claim 6 wherein said step of compacting includes placing the powder in a die and moving a tool into the die to compact the briquette therebetween while placing the tool and die under a uniform stress.

8. A method as set forth in claim 1 which further comprises the steps of placing the briquette on a soft porous surface to allow lubricant and/or binder in the briquette to diffuse from the base of the briquette and thereafter sintering the briquette while on the porous surface whereby the briquette is allowed to slide on the surface as the briquette shrinks during sintering.

9. A compacted product made in accordance with the method of claim 1 characterized in having a linear deviation of +/−0.0010 inch to +−0.0015 inch within a range of from 0.0037 to 0.0050 inch.

10. A method of compacting agglomerated powder comprising the steps of determining the size and shape for a bonded compacted mass;

receiving a mass of agglomerated powder of random sizes;

separating said mass into at least three distinct range of sizes including a fine range, a medium range and a coarse range; and thereafter compacting the agglomerated powder of one of said ranges into said size and shape to form said bonded compacted mass without a linear deviation from said predetermined size and shape.

11. A method as set forth in claim 10 wherein said step of compacting includes placing the powder in a die and moving a tool into the die to compact the powder therebetween while placing the tool and die under a uniform stress.

12. A method of compacting agglomerated powder comprising the steps of receiving a mass of agglomerated powder of random sizes;

separating said mass into at least three distinct range of sizes including a fine range, a medium range and a coarse range;

thereafter compacting the agglomerated powder of one of said ranges into a green briquette characterized in having a self-supporting structure to permit handling for a subsequent sintering operation to form a compacted mass;

placing the briquette on a soft porous surface to allow lubricant and/or binder in the briquette to diffuse from the base of the briquette; and thereafter sintering the briquette while on the porous surface whereby the briquette is allowed to slide on the surface as the briquette shrinks during sintering.

13. A compacted product made in accordance with the method of claim 12 characterized in having a uniform density throughout.

14. A compacted product made in accordance with the method of claim 12 characterized in having a linear deviation of +/−0.0010 inch to +−0.0015 inch within a range of from 0.0037 to 0.0050 inch.

15. A method of compacting agglomerated powder comprising the steps of receiving a mass of agglomerated powder of random sizes;

separating said mass into at least three distinct range of sizes including a fine range, a medium range and a coarse range;

thereafter compacting the agglomerated powder of one of said ranges into a first green briquette and compacting the agglomerated powder of at least one other of said ranges into a second green briquette, each said briquette being characterized in having a self-supporting structure to permit handling for a subsequent sintering operation to form a compacted mass;

sintering said first briquette to obtain a first compacted product; and sintering said seond briquette to obtain a second compacted product wherein said first product and said second product have the same mass, volume and dimensions.

16. A method as set forth in claim 15 wherein further comprising the steps of compacting the agglomerated powder of a third of said ranges into a third green briquette and sintering said third green compact into a third product having the same mass, volume and dimensions as said first and second products.

* * * * *

UNITED STATES PATENT AND TRADEMARK OFFICE

CERTIFICATE OF CORRECTION

PATENT NO. : 6,585,795 B2
DATED : July 1, 2003
INVENTOR(S) : Ira L. Friedman

It is certified that error appears in the above-identified patent and that said Letters Patent is hereby corrected as shown below:

Column 4,
Line 14, change "feast" to -- least --

Signed and Sealed this

Nineteenth Day of August, 2003

JAMES E. ROGAN
*Director of the United States Patent and Trademark Office*